US006448209B1

(12) United States Patent
Gatzke et al.

(10) Patent No.: US 6,448,209 B1
(45) Date of Patent: Sep. 10, 2002

(54) BRAKE CLEANER COMPOSITIONS COMPRISING METHYL ACETATE AND ACETONE AND METHOD OF USING SAME

(75) Inventors: Ken G. Gatzke, Lake Elmo; Christine A. Sobon, Roseville, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 68 days.

(21) Appl. No.: 09/731,951

(22) Filed: Dec. 7, 2000

(51) Int. Cl.[7] ..... C11D 17/00

(52) U.S. Cl. ..... 510/189; 510/245; 510/407; 510/411; 510/505

(58) Field of Search ..... 510/189, 245, 510/407, 411, 505

(56) References Cited

U.S. PATENT DOCUMENTS

| | | | |
|---|---|---|---|
| 5,227,085 | A | 7/1993 | Motsenbocker |
| 5,753,605 | A | 5/1998 | Blatter et al. |
| 5,827,809 | A | 10/1998 | Mainz et al. |
| 5,877,133 | A | 3/1999 | Good |

FOREIGN PATENT DOCUMENTS

| | | |
|---|---|---|
| JP | 6-264100 | 9/1994 |
| JP | 10-330795 | 12/1998 |

OTHER PUBLICATIONS

Database WPI, Section Ch, Week 199412, Derwent Publications Ltd., London, GB; Class E15, AN 1994–098087, XP002181359 & JP 06 049494 A (Nippon Birds KK), Feb. 22, 1994, abstract.

Database WPI, Section Ch, Week 199532, Derwent Publications Ltd., London, GB, Class D24, AN 1995–243893, XP002181360 & JP 07 150198 A (Chuo Aerosol Kagaku KK), Jun. 13, 1995, abstract.

Patent Abstracts of Japan, vol. 014, No. 118 (C–0697), Mar. 6, 1990 & JP 01 318092 A (Asahi Glass Co. Ltd.) Dec. 22, 1989, abstract.

*Primary Examiner*—Necholus Ogden
(74) *Attorney, Agent, or Firm*—Scott R. Pribnow

(57) ABSTRACT

Low VOC content brake cleaner compositions useful for removing oil and particulate contamination from braking system components of vehicles such as automobiles are reported. The brake cleaner compositions comprise about 5% to about 30% by weight methyl acetate; about 25% to about 50% of a hydrocarbon according to the formula $C_nH_{2n+x}$, where n is 5 to 8 and x is 0 or 2; and about 25% to about 55% by weight acetone.

28 Claims, No Drawings

BRAKE CLEANER COMPOSITIONS COMPRISING METHYL ACETATE AND ACETONE AND METHOD OF USING SAME

FIELD

The present invention relates to brake cleaner compositions useful for removing oil and particulate contamination from braking system components of vehicles, for example, automobiles.

BACKGROUND

In order to maintain proper functioning and performance of braking components (e.g., drums, rotors, calipers) on vehicles such as automobiles it is often necessary to clean the braking components (e.g., when replacing or inspecting brake pads or shoes) in order to remove any accumulated contaminants such as oil and brake pad or brake shoe dust.

One method by which brake components may be cleaned is to direct a pressurized stream of air at the contaminated surfaces of the brake components to forcibly dislodge contaminants. Such a technique is disadvantageous in that the particulate contamination, once dislodged, becomes airborne and may pose a health risk, if inhaled. Also, such a method will effectively remove oily deposits from brake components.

A second method involves the use of steam to clean braking components. This method is disadvantageous in that the steam may accelerate corrosion of metal brake system components.

The most commonly used method of cleaning brake components involves the use of spray-applied, solvent-based brake cleaner compositions. Using this method, the brake cleaner composition is sprayed (e.g., using an aerosol can) onto the contaminated brake components where it functions to loosen, dissolve and/or wash away accumulated oil and particulate contamination. Solvent-based brake cleaners typically comprise volatile organic compounds (VOCs) such as toluene, xylene, hexane, heptane, methyl alcohol, and may also include one or more chlorinated hydrocarbons. Due to the environmental awareness occurring today, laws and regulations have been enacted and will be enacted to limit the VIC level in many materials, in particular solvent-based cleaners such as brake cleaners. In California, for example, the California Air Resources Board (CARB) has recently imposed a 45% VIC limit on brake cleaner compositions sold and/or used within the state of California. Chlorinated hydrocarbons such as methylene chloride and perchloroethylene have also been subject to regulation due to their status as hazardous air pollutants (HAP) and suspect carcinogens.

In order to be accepted solvent-based brake cleaners must provide a desirable balance of several important properties. For example, the brake cleaners must quickly and efficiently dissolve oil and must wet out particulate contamination such as brake dust. Further, the brake cleaners must dry at an acceptable rate under a variety of environmental conditions. That is, the brake cleaner must dry at a rate that is slow enough to allow the liquid flow of brake cleaner over the contaminated brake component to carry the dissolved and/or loosened brake contamination off of the contaminated component(s). If the brake cleaner dries too quickly, dissolved and/or loosened brake contamination will simply be redeposited onto the surface to be cleaned as the brake cleaner dries. If the cleaner dries too slowly, on the other hand, it may interfere with proper performance of the brake components. Generally, a brake cleaner should dry within a period of about 15 to 45 seconds after it has been applied. Another important property of a brake cleaner is its solvent strength or its ability to dissolve and/or loosen brake contamination. If the solvent compatibility with the contaminants is too low, the brake cleaner will not be effective in removing contamination from the braking component. The solvent may also undesirably attack brake system components (e.g., rubber hoses, wheel cylinder boots, and the like) and other vehicle components (e.g., body side moldings, paint, plastics, wheels and tires) during use. Yet another important property of a brake cleaner is odor. Although inhalation of brake cleaners is to be avoided, it is inevitable that during use of a brake cleaner some of the brake cleaner will be inhaled by a worker who is either applying the brake cleaner or working in the vicinity of where the brake cleaner is being applied. In view of this, it is desirable to provide a brake cleaner composition that has an acceptable and low odor.

In view of the foregoing, an effective spray-applied brake cleaner composition having low VIC content (i.e., less than 45%), low toxicity, acceptable odor, acceptable dry time, and excellent cleaning performance is desired.

SUMMARY

The present invention provides a brake cleaner composition comprising (1) about 5% to about 30% by weight methyl acetate; (2) about 25% to about 50% of a hydrocarbon according to formula $C_nH_{2n+x}$, where n is 5 to 8 and x is 0 or 2; and (3) about 25% to about 55% by weight acetone.

In a preferred embodiment, the hydrocarbon is selected from the group consisting of n-pentane, isopentane, n-hexane, isohexane, n-heptane, isoheptane, n-octane, isooctane, methyl cyclohexane, cyclohexane, and mixtures thereof.

In another preferred embodiment of the brake cleaner composition the methyl acetate is present in an amount ranging from about 5% to about 20% by weight of the composition, more preferably 5% to 10% by weight.

In another preferred embodiment of the brake cleaner composition the hydrocarbon is present in amount ranging from about 30% to about 45% by weight of the composition.

In another preferred embodiment, the acetone is present in an amount ranging from about 45% to about 50% by weight of the composition.

In another preferred embodiment, the brake cleaner composition further includes water in an amount ranging from about 1% to 15% by weight.

In another preferred embodiment the brake cleaner composition is provided in a pressure-resistant container under the pressure of an aerosol propellant. Preferred aerosol propellants include, for example, propane, isobutane, normal butane, nitrogen, carbon dioxide, and mixtures thereof.

The brake cleaner composition preferably includes a fragrance additive such as d-limonene. Fragrance additive d-limonene is typically present in an amount ranging from about 0.05% to about 3% by weight of the composition.

Preferred embodiments of the brake cleaner composition have less than about 50% by weight volatile organic compounds, more preferably less than about 45% by weight volatile organic compounds.

DETAILED DESCRIPTION

Brake cleaner composition of the present invention comprise at least the following three components:

(1) about 5 to about 30% by weight of methyl acetate;

(2) about 25% to about 50% by weight of a hydrocarbon according to the formula:

$$C_nH_{2n+x},$$

where n is 5 to 8;
x is 0 or 2; and (3) about 25% to about 55% by weight acetone.

Brake cleaner compositions of the present invention comprise from about 5% to about 30% by weight methyl acetate ($CH_3CO_2CH_3$). Presently, methyl acetate is not classified as a volatile organic compound making its use in brake cleaner compositions of the present invention desirable. Methyl acetate combined with a hydrocarbon of the formula above provides a composition having a high degree of solvency to oil and grease and further provides brake dust wetting capability. In addition, methyl acetate has a desirable level of volatility allowing for the formulation of brake cleaner compositions having a desirable drying rate. Methyl acetate also acts to reduce and/or dilute the objectionable odor of acetone, preferably to an acceptable level. In preferred embodiments, the brake cleaner composition of the present invention comprises from about 5% to about 10% by weight methyl acetate.

Brake cleaner compositions of the present invention further comprises at least one hydrocarbon solvent fitting within the general formula (1):

$$C_nH_{2n+x}, \quad (1)$$

wherein: n ranges from 5 to 8 (more preferably ranging from 6 to 7); and x is 0 or 2 (preferably 2).

Hydrocarbons included within this formula include, for example, n-pentane (n-$C_5H_{12}$), isopentane (i-$C_5H_{12}$), n-hexane (n-$C_6H_{14}$), isohexane (i-$C_6H_{14}$), n-heptane (n-$C_7H_{16}$), isoheptane (i-$C_7H_{16}$), n-octane (n-$C_8H_{18}$), and isooctane (i-$C_8H_{18}$), methyl cyclohexane ($C_7H_{14}$), cyclohexane ($C_6H_{12}$). Optionally, brake cleaner compositions of the present invention may include more than one hydrocarbon according to general formula (1). The preferred hydrocarbon of formula (1) for use in brake cleaner compositions of the present invention is n-heptane due to its balance of solvent strength, drying rate (i.e., volatility), toxicity and odor. As hydrocarbons of general formula (1) are classified as volatile organic compounds, it is preferred to limit the total amount of these hydrocarbons in order to provide a low VIC brake cleaner composition. Brake cleaner compositions of the present invention include at least one hydrocarbon according to general formula (1) in an amount ranging from about 25% to about 75% by weight of the composition. More preferably, brake cleaner compositions of the present invention include at least one hydrocarbon according to general formula (1) in an amount ranging from about 25% to about 50% by weight, and most preferably ranging from about 30% to about 45% by weight. Heptane suitable for use in brake cleaner compositions of the present invention is commercially available under the trade designation "EXXSOL HEPTANE FLUID" from Exxon Chemical Company.

Brake cleaner compositions of the present invention also include acetone ($CH_3COCH_3$), an organic solvent that is not presently classified as a volatile organic compound. Acetone is present in brake cleaner compositions of the present invention in an amount ranging from about 25% to about 55% by weight, more preferably ranging from about 25% to about 55% by weight, most preferably about 45% to about 50% by weight. Suitable acetone may be obtained under the trade designation "ACETONE 99.5% GRADE" from Shell Chemical Company.

Brake cleaner compositions of the present invention may optionally include water. Water may be intentionally added to the formulation as a low cost diluent. If added, water is typically included in an amount ranging from about 2% to about 15% by weight of the brake cleaner composition. Water may also be present in as an impurity in one or more of the components of the brake cleaner composition. For example, industrial grade methyl acetate typically includes about 0.05% to about 5% by weight water. If added, it is generally preferred to use deionized or distilled water to reduce the quantity of dissolved mineral in the brake cleaner composition. If water is present in the brake cleaner composition, it may be desirable to add a corrosion inhibitor to reduce or prevent corrosion of aerosol cans.

Brake cleaner compositions of the present invention may optionally include a fragrance additive. One preferred fragrance additive is d-limonene that provides a citrus odor. When included in a brake cleaner composition of the present invention a fragrance additive such as d-limonene is typically added in an amount ranging from about 0.05% to about 3% by weight of the total composition. Suitable d-limonene fragrance additive is commercially available under the trade designation "D-LIMONENE, TECHNICAL GRADE" from Florida Chemical Company.

Brake cleaner compositions of the present invention are preferably supplied in an aerosol spray can for convenient application. When provided in an aerosol spray can, a propellant is included with the brake cleaner formulation. Suitable propellants include, for example, nitrogen, carbon dioxide, propane, isobutane, normal butane, and mixtures thereof. Typically, liquid aerosol propellants such as propane, butane, and isobutane are added to the brake cleaner composition in an amount ranging from about 5% to about 15% by weight of the composition. When the aerosol propellant is itself classified as a volatile organic compound (e.g., propane, butane, isobutane) the quantity of hydrocarbon solvent of formula (1) is preferably reduced in order to provide a composition having less than 45% by weight total volatile organic compounds. When gases such as nitrogen and carbon dioxide are used as the propellant, the gas propellant is typically present in an amount ranging up to about 2% by weight. Propane suitable as an aerosol propellant is commercially available under the trade designation "A-110" from Technical Propellants, Inc.

Brake cleaner compositions of the present invention may be prepared by mixing the desired components, for example, using a low shear type mixer. The order of addition of the various components has not been shown to affect the resulting brake cleaner composition. Typically and preferably, explosion-proof manufacturing facilities and equipment must be used in mixing and packaging of the brake cleaner compositions.

Brake cleaner compositions of the present invention are preferably provided in and aerosol spray can to facilitate application of the composition to difficult-to-reach surfaces such as are typically present in brake system assemblies. In typical use, the brake cleaner compositions of the present invention are preferably spray-applied to the surface(s) to be cleaned until such surface(s) are thoroughly wetted with the brake cleaner composition. After initial wetting, it may be desirable to further spray the brake cleaner composition onto the surface(s) to be cleaned in order to loosen and/or flush away contaminants. Multiple applications of the brake cleaner composition to the surface to be cleaned may be desired in some circumstances. Any run-off of brake cleaner composition and contamination must be collected and disposed of using proper disposal techniques.

Objects and advantages of this invention are further illustrated by the following examples, but the particular materials and amounts thereof recited in these examples, as well as other conditions and details, should not be construed to unduly limit this invention. All parts and percentages are by weight unless otherwise indicated.

EXAMPLES

Test Method A:

Preparation of Panel.

A 4" by 8" 16 gauge cold rolled steel panel was cleaned by wiping both major surfaces with an isopropanol wetted lint-free towel. The cleaned panel was then weighed and the weight of the panel was recorded as "weight clean" to +/−0.01 grams. A preweighed aliquot of approximately 0.3 grams of lubricating oil (Mobil 30 weight lubricating oil) was applied to the approximate center of one surface of the panel using a dropper. Next, the surface of the panel wetted with lubricating oil was hand sanded for 2 minutes using moderate pressure using a single sheet of sandpaper of the type commercially available under the trade designation #"240 ELEK-TRO-CUT CLOTH" (available from Minnesota Mining & Manufacturing Company, St. Paul, Minn.). The resulting sanded panel contained an even coating of oil, grit (i.e., dislodged from the sandpaper), and steel particles (i.e., abraded from the panel during the sanding operation). Following the sanding, the resulting panel was again weighed and the weight of the panel was recorded as "weight soiled" to +/−0.01 grams.

Testing of Brake Cleaner Compositions.

One coated test panel (prepared as described above) was fixed in a holder in order to position the 8" side of the coated panel at an angle of inclination of 70 degrees with respect to the horizontal surface of the hood. The brake cleaner composition to be tested was provided in an aerosol spray can with an aerosol spray nozzle fitted with a 4 inch (10.2 cm) extension tube. The brake cleaner composition was spray applied to the coated panel using a horizontal spray pattern beginning at the top of the coated test panel. During the spray application of the brake cleaner composition the spray end of the extension tube was held at a distance of approximately 6 inches (15.3 cm) from the surface of the test panel. Multiple horizontal spray passes were made until the test panel was completely coated with brake cleaner composition. At this point a stopwatch was started in order to measure the dry time of the brake cleaner composition. The stopwatch was stopped when the brake cleaner composition at ¼ inch (0.64 cm) from the bottom of the panel was dry. The test panel was reweighed and the weight recorded as "weight clean" to +/−0.01 grams. The percent of oil and grit retention was then calculated using the following formula:

$$\%\,\text{Oil and Grit Retention} = \frac{(\text{weight clean} - \text{weight initial}) * 100}{(\text{weight soiled} - \text{weight initial})}$$

For some samples the % Oil and Grit Retention calculated using the above formula is reported as <0.00%. This negative value indicates that the "weight clean" was less than the "weight initial" for the sample. This result is possible since the hand sanding of the test panel may cause removal of steel particles thereby reducing its weight. Test panels were rated using a scale of 1 to 5 after visual inspection. A score of 1 indicates no cleaning or minimal cleaning. A score of 5 indicates excellent cleaning.

Comparative Example A:

3M BRAKE CLEANER #08906 (manufactured by Minnesota Mining & Manufacturing Company, St. Paul, Minn; now discontinued); Active ingredient: 1,1,1, trichloroethane and perchloroethylene.

Comparative Example B:

3M GASKET PREP & PARTS CLEANER #08909 (manufactured by Minnesota Mining & Manufacturing Company, St. Paul, Minn; now discontinued); Active ingredient: 1,1,1, trichloroethane.

Comparative Example C:

BERRYMAN NON-CHLORINATED BRAKE CLEANER #2421 (available from Berryman Products Inc., Arlington, Tex.); Active ingredients: acetone, toluene, and methanol.

Comparative Example D:

3M HIGH PROWER BRAKE CLEANER #08880 (available from Minnesota Mining & Manufacturing Company, St. Paul, Minn.); Active ingredients: heptane, xylene, methanol, and ethyl benzene.

Comparative Example E:

3M HIGH POWER BRAKE CLEANER #08893 (available from Minnesota Mining & Manufacturing Company, St. Paul, Minn.); Active ingredients: decamethylcyclopentasiloxane, heptane, xylene, and acetone.

Comparative Example F:

3M BRAKE CLEANER #08895 (available from Minnesota Mining & Manufacturing Company, St. Paul, Minn.); Active ingredients: heptane, xylene, methanol, ethyl benzene.

Examples 1–12 of brake cleaner compositions of the present invention were prepared according to the formulations in Table 1.

TABLE 1

| Example | Methyl acetate (grams) | Heptane (grams) | Acetone (grams) | Deionized water (grams) | A-110 (grams) | d-limonene (grams) |
|---|---|---|---|---|---|---|
| Example 1 | 75 | 160 | 205 | 0 | 60 | 0 |
| Example 2 | 75 | 177.5 | 205 | 0 | 40 | 2.5 |
| Example 3 | 75 | 180 | 195 | 10 | 40 | 0 |
| Example 4 | 75 | 157.5 | 195 | 10 | 60 | 2.5 |
| Example 5 | 37.5 | 168.75 | 237.5 | 5 | 50 | 1.25 |
| Example 6 | 37.5 | 168.75 | 237.5 | 5 | 50 | 1.25 |
| Example 7 | 37.5 | 168.75 | 237.5 | 5 | 50 | 1.25 |
| Example 8 | 37.5 | 168.75 | 237.5 | 5 | 50 | 1.25 |
| Comp. Ex. H | 0 | 157.5 | 280 | 0 | 60 | 2.5 |
| Comp. Ex. I | 0 | 160 | 270 | 10 | 60 | 0 |
| Comp. Ex. J | 0 | 177.5 | 270 | 10 | 40 | 2.5 |

Examples 1–8 and Comparative Examples A–J were subjected to Test Procedure A and the results are reported in Table 2.

TABLE 2

| Example | Retained Grit (weight %) | Rating | Odor |
|---|---|---|---|
| Example 1 | <0.00% | 5 | Acceptable |
| Example 2 | <0.00% | 5 | Acceptable |
| Example 3 | <0.00% | 5 | Acceptable |
| Example 4 | <0.00% | 5 | Acceptable |
| Example 5 | <0.00% | 5 | Acceptable |
| Example 6 | 0.00% | 5 | Acceptable |
| Example 7 | <0.00% | 5 | Acceptable |
| Example 8 | <0.00% | 5 | Acceptable |
| Comp Example A | <0.00% | 5 | Acceptable |
| Comp Example B | 34.62% | 2 | Acceptable |
| Comp Example C | 75.86% | 1 | Not acceptable |
| Comp Example D | 0.00% | 5 | Acceptable |
| Comp Example E | 3.45% | 3 | Acceptable |
| Comp Example F | <0.00% | 5 | Acceptable |
| Comp. Example G | <0.00% | 5 | Not acceptable |
| Comp. Example H | <0.00% | 5 | Not acceptable |
| Comp. Example I | <0.00% | 5 | Not acceptable |
| Comp. Example J | <0.00% | 5 | Not acceptable |

The complete disclosures of all patents, patent applications, and publications are incorporated herein by reference as if individually incorporated. Various modifications and alterations of this invention will become apparent to those skilled in the art without departing from the scope and spirit of this invention, and it should be understood that this invention is not to be unduly limited to the illustrative embodiments set forth herein.

What is claimed is:

1. A brake cleaner composition comprising:

about 5% to about 30% by weight methyl acetate;

about 25% to about 50% of a hydrocarbon according to formula (1):

$$C_nH_{2n+x}, \quad (1)$$

where:

n is 5 to 8;

x is 0 or 2; and about 25% to about 55% by weight acetone.

2. The composition of claim 1 further including water.

3. The composition of claim 1 wherein the hydrocarbon is selected from the group consisting of n-pentane, isopentane, n-hexane, isohexane, n-heptane, isoheptane, n-octane, isooctane, methyl cyclohexane, cyclohexane, and mixtures thereof.

4. The composition of claim 1 wherein the methyl acetate is present in an amount ranging from about 5% to about 20% by weight of the composition.

5. The composition of claim 1 wherein the hydrocarbon is present in amount ranging from about 30% to about 45% by weight of the composition.

6. The composition of claim 1 wherein the hydrocarbon is n-heptane.

7. The composition of claim 1 wherein the acetone is present in an amount ranging from about 45% to about 50% by weight of the composition.

8. The composition of claim 1 wherein the methyl acetate is present in the composition in an amount ranging from about 5% to 10% by weight.

9. The composition of claim 2 wherein the water is present in the composition in an amount ranging from about 1% to 15% by weight.

10. The composition of claim 1 further including an aerosol propellant.

11. The composition of claim 10, wherein the aerosol propellant is selected from the group consisting of propane, isobutane, normal butane, nitrogen, carbon dioxide, and mixtures thereof.

12. The composition of claim 1 further including a fragrance additive.

13. The composition of claim 12 wherein the fragrance additive is d-limonene.

14. The composition of claim 13 wherein the d-limonene is present in an amount ranging from about 0.05% to about 3% by weight of the composition.

15. The composition of claim 1 having less than 50% by weight volatile organic compounds.

16. A brake cleaner composition comprising:

about 5% to about 10% by weight of methyl acetate;

about 30% to about 45% by weight n-heptane; and about 45% to about 50% acetone.

17. The composition of claim 16 further including water.

18. The composition of claim 17 wherein the water is present in the composition in an amount ranging from about 1% to 15% by weight.

19. The composition of claim 16 further including an aerosol propellant.

20. The composition of claim 19, wherein the aerosol propellant is selected from the group consisting of propane, isobutane, normal butane, nitrogen, carbon dioxide, and mixtures thereof.

21. The composition of claim 16 further including a fragrance additive.

22. The composition of claim 21 wherein the fragrance additive is d-limonene.

23. The composition of claim 22 wherein the d-limonene is present in an amount ranging from about 0.05% to about 3% by weight of the composition.

24. The composition of claim 1 having about 50% by weight or less of volatile organic compounds.

25. A method of cleaning brake system components comprising the steps of:

(a) providing a brake system component; and (b) applying a brake cleaner composition to the brake system component, said brake cleaner composition comprising:

about 5% to about 30% by weight methyl acetate;

about 25% to about 50% of a hydrocarbon according to formula (1)

$$C_nH_{2n+x}, \quad (1)$$

where:

n is 5 to 8;

x is 0 or 2; and about 25% to about 55% by weight acetone.

26. The method of cleaning brake system components of claim 25 wherein said brake system component is selected from the group consisting of drums, calipers and rotors.

27. The method of cleaning brake system components of claim 25 wherein step (b) comprises spray applying the brake cleaner composition to the brake system component.

28. The method of cleaning brake system components of claim 27 wherein the brake cleaner is provided in an aerosol spray can.

* * * * *

UNITED STATES PATENT AND TRADEMARK OFFICE

CERTIFICATE OF CORRECTION

PATENT NO. : 6,448,209 B1
DATED : September 10, 2002
INVENTOR(S) : Gatzke, Kenneth G.

It is certified that error appears in the above-identified patent and that said Letters Patent is hereby corrected as shown below:

Title page,
Item [75], Inventors, "Ken G. Gatzke" should be -- Kenneth G Gatzke --

Column 1,
Line 43, "limit the VIC level in many materials," should be -- limit the VOC level in many materials, --
Line 46, "recently imposed a 45% VIC limit on brake cleaner" should be -- recently imposed a 45% VOC limit on brake cleaner --

Column 2,
Line 20, "composition having low VIC content" should be -- composition having low VOC content --

Column 3,
Line 46, "VIC brake cleaner composition." should be -- VOC brake cleaner composition. --

Column 4,
Line 54, "preferably provided in and aerosol spray" should be -- preferably provided in an aerosol spray --

Column 6,
Line 21, "3M HIGH PROWER BRAKE CLEANER" should be -- 3M HIGH POWER BRAKE CLEANER --

Signed and Sealed this

Twenty-fifth Day of February, 2003

JAMES E. ROGAN
*Director of the United States Patent and Trademark Office*